US008256058B2

(12) United States Patent
Telwar

(10) Patent No.: US 8,256,058 B2
(45) Date of Patent: Sep. 4, 2012

(54) DUAL SIDED COSMETICS BRUSH

(75) Inventor: Anisa Telwar, Atlanta, GA (US)

(73) Assignee: Anisa International, Inc., Atlanta, GA (US)

( * ) Notice: Subject to any disclaimer, the term of this patent is extended or adjusted under 35 U.S.C. 154(b) by 154 days.

(21) Appl. No.: 12/462,681

(22) Filed: Aug. 7, 2009

(65) Prior Publication Data

US 2010/0037407 A1 Feb. 18, 2010

Related U.S. Application Data

(60) Provisional application No. 61/188,754, filed on Aug. 12, 2008.

(51) Int. Cl.
*A46B 9/02* (2006.01)
*A46B 9/06* (2006.01)

(52) U.S. Cl. ..... 15/160; 15/191.1; 15/207.2; 15/DIG. 5; 15/DIG. 6

(58) Field of Classification Search ..... 15/159.1, 15/160, 191.1, 207.2, DIG. 5, DIG. 6
See application file for complete search history.

(56) References Cited

U.S. PATENT DOCUMENTS

| | | | | | |
|---|---|---|---|---|---|
| 3,072,944 | A * | 1/1963 | Clayton et al. | 15/167.1 |
| 4,483,036 | A * | 11/1984 | Sayklay | 15/160 |
| 4,610,045 | A * | 9/1986 | Rauch | 15/167.1 |
| 4,756,039 | A * | 7/1988 | Pardo | 15/160 |
| 4,998,315 | A * | 3/1991 | Pessis | 15/160 |
| 5,220,702 | A * | 6/1993 | Howell et al. | 15/160 |
| 5,507,063 | A * | 4/1996 | Hirsch | 15/160 |
| 5,588,447 | A * | 12/1996 | Gueret | 132/200 |
| 6,224,287 | B1 * | 5/2001 | Gieux | 401/282 |
| 6,367,114 | B1 * | 4/2002 | Babkowski | 15/207.2 |
| 6,513,183 | B2 * | 2/2003 | Dorf | 15/191.1 |
| 7,159,950 | B2 * | 1/2007 | Young-Chul | 300/21 |
| 2002/0078902 | A1 | 6/2002 | Ehrmann | |
| 2003/0182750 | A1 * | 10/2003 | Nishida et al. | 15/193 |
| 2007/0177930 | A1 | 8/2007 | Byun | |
| 2008/0141479 | A1 | 6/2008 | Mink | |

FOREIGN PATENT DOCUMENTS

| | | | |
|---|---|---|---|
| JP | 2006-075329 D | | 3/2006 |
| JP | 2008-168108 | * | 7/2008 |

OTHER PUBLICATIONS

International Search Report and Written Opinion from PCT/US2009/004449 dated Mar. 22, 2010.

* cited by examiner

*Primary Examiner* — Randall Chin
(74) *Attorney, Agent, or Firm* — Alston & Bird LLP

(57) ABSTRACT

One embodiment of a cosmetic applicator brush comprises a handle and a brush head. The head is in two halves made of different bristles.

9 Claims, 1 Drawing Sheet

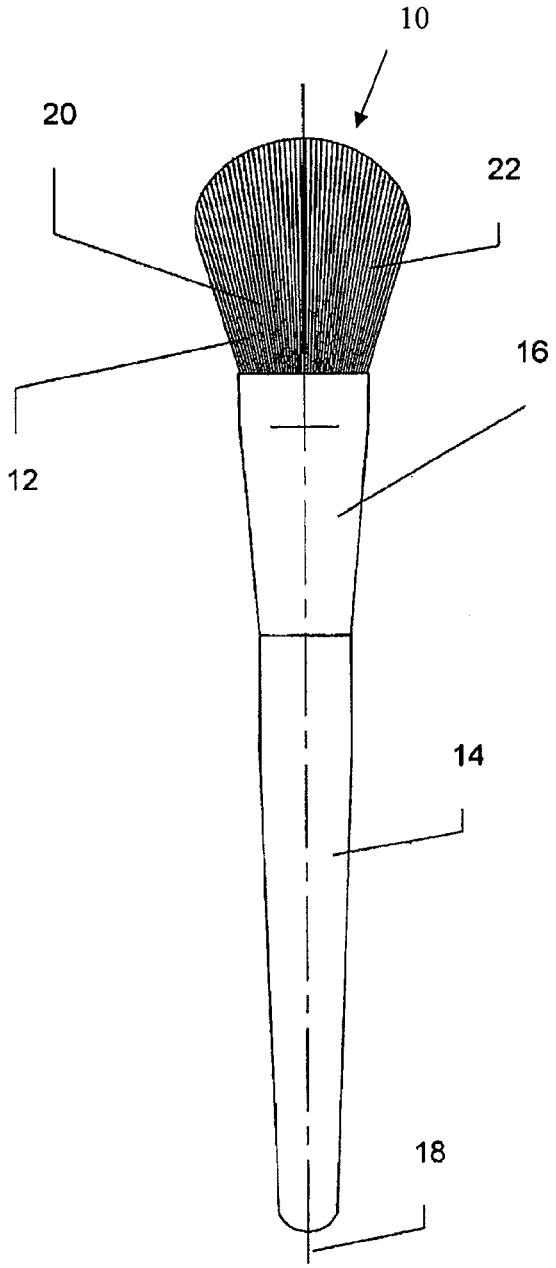
10
20
22
16
12
14
18

DUAL SIDED COSMETICS BRUSH

CROSS-REFERENCE TO RELATED APPLICATION

This application claims benefit of U.S. Provisional Patent Application No. 61/188,754, filed on Aug. 12, 2008 by Anisa Telwar, which is incorporated herein by reference in its entirety.

BACKGROUND

Cosmetic brushes are the main applicators for people applying makeup. Different sorts of makeup require different brushes such as a lip brush, an eye shadow brush etc. In cosmetic applicators currently commercially available, one brush has only one function, so the user needs to buy a set of brushes to achieve a satisfactory makeup application.

In other fields, brushes with more than one set of bristles have been proposed. The bristles typically project sideways from a head end of a handle, in opposite directions, so that either set of bristles can be used without involving the other set. However, this is unsuitable for many cosmetic applications, where a brush with the bristles extending endways from the handle is preferred.

SUMMARY

In accordance with an embodiment of the present invention, there is provided a brush having a handle and a head. The head comprises bristles extending endways from an end of the handle. Different sides of the brush head have different properties.

In accordance with another embodiment of the invention, there is provided a brush head comprising bristles all extending in the same general direction. The brush head comprises two sides in which the bristles have different properties.

The brush head may be generally circular, with two generally semicircular sides having different properties.

The different properties may be provided by using different fibers for the bristles. In general, a "fiber" includes anything that can be used for the bristles of a brush suitable for applying cosmetics, skin care products, or the like.

The two sides may be, for example, one stiffer than the other. The two sides may use bristles of different thicknesses. The two sides may use bristles of different materials, such as a natural bristle and a synthetic bristle. The materials may be a material with greater affinity for a cosmetic that is to be applied, for transferring the cosmetic to the skin of the user, and a material with lesser affinity for the cosmetic, for blending the applied cosmetic on the skin.

The bristles on the two sides of the brush may be different colors, providing both an esthetically interesting appearance and an easy way for a user to distinguish which side is which.

It is preferred in most cases for the brush head to be fairly sharply divided into the two sides. However, the two sides may blur into each other to some extent, either to provide transitional or intermediate properties, or because of the practicalities of manufacture.

It is preferred in most cases for the sides of the brush head to be roughly equal halves. However, one side may alternatively be larger than the other, either as major and minor sectors, separated by two radii, or as major and minor segments separated by a chord, or divided in some other way.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

The single FIGURE is a side view of an embodiment of a brush.

DETAILED DESCRIPTION OF THE DRAWINGS

Reference will now be made in detail to one or more embodiments of the present brushes, an example of which is illustrated in the accompanying drawings. The embodiments are described by way of explanation, and not by way of limitation.

Referring to the drawings, one embodiment of a brush indicated generally by the reference numeral 10 comprises a brush head 12, a brush handle 14, and as ferrule 16.

The handle 14 is generally circular in cross section, but may be another shape such as elliptical, and has a longitudinal axis 18. As shown in FIG. 1, the handle 14 is relatively long and thin. However, the length and thickness of the handle 14 depends on the intended use of the specific brush, as is well known to those skilled in the art.

The brush head 12 comprises bristles 20, 22 that are aligned generally parallel to the axis 18. As shown in FIG. 1, the bristles 20, 22 spread slightly away from the axis 18 in the direction away from handle 14. The amount of spread may vary. The bases of the bristles 20, 22 are surrounded, supported, and secured to an end of handle 14 by ferrule 16.

The bristles 20, 22 are of two different sorts, each making up one half of the head 12. For example, the bristles 20 making up one half of the head 12 may be natural bristles, and the bristles 22 making up the other half of the head 12 may be synthetic fiber. The bristles 20 may be a different color from the bristles 22, either naturally or through being deliberately colored.

As shown in FIG. 1, the head 12 is broadly rounded, so that by applying the brush 10 obliquely to a flat surface, bristles of only one sort 20 or 22 can be brought into contact with the surface.

In use, the brush 10 may be used like a conventional cosmetic applicator brush to apply cosmetics or skin care products to the skin, blend cosmetics into the skin or with other cosmetics, and the like. However, by holding the brush 10 obliquely to the skin or to a container of cosmetic material, and by rotating the brush 10 to a suitable orientation about the axis 18, a chosen one of the bristles 20 or 22, or a mixture at the borderline between the two halves, can be used.

For example, one sort of bristles 20 or 22 may be more suitable for transferring a cosmetic from a container to the skin, and the other sort of bristles 22 or 20 may be more suitable for blending the cosmetic on the skin. For mineral based makeup, such as powders, blushes, bronzers, etc., it may be desired to use synthetic fibers to apply the makeup and natural fibers to blend. For example, a blush may be applied to the user's cheekbone with the synthetic fibers and the blush may then be blended on the cheekbone with the natural fibers. For pan or pressed products such as pressed powders, eye shadows, etc., it may be desired to use natural fibers to apply and synthetic fibers to blend. For example, eye shadow may be applied with the natural fibers and then blended with the synthetic side of the brush. However, two different natural fibers or two different synthetic fibers could also be used.

For example, the two sides may be used for applying different cosmetics, reducing the level of cross-contamination of one cosmetic by the other without the need to use two different brushes. A brush with two sides of different appearance but having fibers of the same or similar mechanical properties may then be useful. A brush in which the two sides differ only in color or other properties of appearance may also be useful for user training or education, or for easy identification by the user of brushes of similar size and shape.

By having the two sides 20, 22 of markedly different colors, for example, one side white and the other side black, the user can tell at a glance which side is which, and can immediately and correctly align the brush for use.

Various modifications and variations can be made in the present invention without departing from the spirit or scope of the invention. Thus, it is intended that the present invention cover the modifications and variations of this invention provided they come within the scope of the appended claims and their equivalents.

Although distinct embodiments have been described, the skilled person will understand how features of different embodiments may be combined.

What is claimed is:

1. A brush comprising a generally elongate handle having a longitudinal axis and a head extending from one end of said handle, said head having an application end viewed as generally circular when viewing said application end substantially along said longitudinal axis, wherein said head comprises bristles extending endways from said one end of said handle, said bristles including:

a first set of bristles having a first set of properties and including a first set of bristle ends; and a second set of bristles adjacent to said first set of bristles, said second set of bristles having a second set of properties and including a second set of bristle ends, said first and second sets of bristles being separated relative to each other generally along a dividing plane lying generally along said longitudinal axis of said handle, and said first and second sets of bristle ends each configured such that they combine to define approximately at least a half sphere, with each of said two sets of bristle ends viewed as generally semicircular when said application end is viewed substantially along said longitudinal axis.

2. A brush according to claim 1, wherein the first set of bristles is the same shape and size as the second set of bristles.

3. A brush according to claim 2, wherein the shape of each of the first set of bristles and the second set of bristles is viewed as generally semicircular when viewing said application end substantially along said longitudinal axis.

4. A brush according to claim 1, wherein the first set of bristles has a first stiffness and the second set of bristles has a second stiffness.

5. A brush according to claim 4, wherein the first set of bristles is comprised of bristles with a first thickness and the second set of bristles is comprised of bristles with a second thickness.

6. A brush according to claim 1, wherein the first set of bristles is comprised of a first type of material and the second set of bristles is comprised of a second type of material.

7. A brush according to claim 6, wherein the bristles of the first set of bristles are comprised of a natural material and the bristles of the second set of bristles are of a synthetic material.

8. A brush according to claim 1, wherein the first set of bristles is a first color and the second set of bristles is a second color, and wherein at least one of said first color and said second color is a result of a coloring process.

9. A brush according to claim 1, wherein said head extends from said one end of said handle such that each of said first and second sets of bristles spread slightly away from said longitudinal axis in the direction away from said one end of said handle.

* * * * *